US005791262A

United States Patent [19]

Knight et al.

[11] Patent Number: 5,791,262

[45] Date of Patent: *Aug. 11, 1998

[54] REINFORCED PLASTIC PALLET

[75] Inventors: John W. Knight, New Concord; Paul W. Baker, Cambridge; David Paul Jones, Kimbolton; Daniel Clark Mullock, Cincinnati, all of Ohio

[73] Assignee: The Fabri-Form Co., Byesville, Ohio

[ * ] Notice: The term of this patent shall not extend beyond the expiration date of Pat. No. 5,755,162.

[21] Appl. No.: 258,433

[22] Filed: Jun. 10, 1994

Related U.S. Application Data

[63] Continuation-in-part of Ser. No. 194,866, Feb. 14, 1994, Pat. No. 5,596,933.

[51] Int. Cl.[6] ..... B65D 19/00

[52] U.S. Cl. ..... 108/57.25; 108/57.27; 108/901

[58] Field of Search ..... 100/901, 902, 100/55.3, 55.1, 51.1, 51.11

[56] References Cited

U.S. PATENT DOCUMENTS

| | | |
|---|---|---|
| Re. 32,344 | 2/1987 | Wind . |
| D. 226,183 | 1/1973 | Fujii et al. . |

(List continued on next page.)

FOREIGN PATENT DOCUMENTS

| | | | |
|---|---|---|---|
| 21 65 676 | 7/1973 | Germany . | |
| 25 35 681 | 2/1977 | Germany . | |
| 26 51 929 | 5/1978 | Germany . | |
| 29 09 541 | 9/1980 | Germany . | |
| 2273695 | 6/1994 | United Kingdom | 108/55.1 |

OTHER PUBLICATIONS

Advertisement from Pro–Form Germantown, WI (2 pages).
Advertisement from Global Equipment Co. (1 page).
Front Cover of Aug. 31, 1992, Chemical & Engineering News (1 page).
Advertisement from Litco International Inc., Vienna, Ohio, Showing Inca Pallet (4 pages).
Advertisement from Tuscarora Container System, Beaver, PA (1 page).
Advertisement from United States Corrulite Corporations, Clewiston, Florida (1 page).
p. 92, from Jun. 6, 1972, Official Gazette showing abstract of U.S. Pat. No. 3,667,403.
p. 510 from Aug. 9, 1983, Official Gazette showing abstract of U.S. Pat. No. 4,397,247.
p. 1027 from Aug. 19, 1986, Official Gazette showing abstract of U.S. Pat. No. 4,606,278.
p. 547 from Feb. 9, 1971, Official Gazette showing abstract of U.S. Pat. No. 3,561,375.
p. 100 from Aug. 1, 1972, Official Gazette showing abstract of U.S. Pat. No. 3,680,495.
p. 81 from Mar. 4, 1975, Offical Gazette showing abstract of U.S. Pat. No. 3,868,915.
p. 870 from Jul. 21, 1981, Official Gazette showing abstract of U.S. Pat. No. 4,279,204.

*Primary Examiner*—Jose V. Chen
*Attorney, Agent, or Firm*—Renner, Kenner, Greive, Bobak, Taylor & Weber

[57] ABSTRACT

A reinforced pallet (10) includes an upper surface (11) and a pair of opposing support sides (14, 15). The pallet (10) also includes at least one reinforcing bar channel (50) and a reinforcing bar (40) received within reinforcing bar channel (50). A twin-sheet pallet (10) is formed vacuum-forming a first plastic sheet (33*a*) to a first mold section (30) and a second plastic sheet (33*b*) to a second mold sheet (31), wherein a preselected portion of the second mold section (31) is sealed such that the second plastic sheet (33*b*) is not vacuum-formed. The mold sections (30, 31) are then moved together and the sheets (33*a*, 33*b*) are compressed together at preselected locations. A thermoformed, plastic pallet (10) for bearing and positioning a load, also includes and a retaining wall assembly (90) carried by the upper surface (11); the retaining wall assembly (90) including a wall-receiving slot (91) in the upper surface (11) and a retaining wall (92) received and positioned within the slot (91).

15 Claims, 7 Drawing Sheets

U.S. PATENT DOCUMENTS

D. 267,126 11/1982 Jonebrant .
2,486,284 10/1949 Horwitz .
2,634,932 4/1953 Withers .
2,918,190 12/1959 Martin .
2,950,078 8/1960 Phillips .
2,973,931 3/1961 Brown .
3,145,870 8/1964 Lockwood .
3,187,691 6/1965 Leitzel .
3,346,137 10/1967 Ricci .
3,371,816 3/1968 Ricci .
3,467,032 9/1969 Rowlands et al. .
3,524,415 8/1970 Heiman .
3,526,195 9/1970 Maryenovich .
3,561,375 2/1971 Hammond et al. .
3,610,173 10/1971 McIlwraith et al. .
3,636,888 1/1972 Angelbeck, Jr. .
3,664,271 5/1972 Wolder et al. .
3,664,570 5/1972 Kupersmit .
3,667,403 6/1972 Angelbeck, Jr. .
3,680,495 8/1972 Pike .
3,680,496 8/1972 Westlake, Jr. .
3,696,761 10/1972 Brown .
3,699,901 10/1972 Cook, III .
3,702,100 11/1972 Wharton .
3,707,127 12/1972 Palfey .
3,719,157 3/1973 Arcocha et al. .
3,750,596 8/1973 Box .
3,757,704 9/1973 Allgeyer et al. .
3,768,423 10/1973 Cook, III et al. .
3,776,145 12/1973 Anderson et al. .
3,832,955 9/1974 Pottinger et al. .
3,868,915 3/1975 Hafner .
3,944,070 3/1976 Cardwell et al. .
3,948,190 4/1976 Cook, III et al. .
3,968,895 7/1976 Barnes, Jr. et al. .
3,993,168 11/1976 Kubick .
4,000,704 1/1977 Griffin, Jr. .
4,013,020 3/1977 Schoeller et al. .
4,015,544 4/1977 Szatkowski .
4,042,107 8/1977 Kendig .
4,254,873 3/1981 Cook, III et al. .
4,279,204 7/1981 Propst .
4,290,369 9/1981 Propst et al. .
4,372,028 2/1983 Clark et al. .
4,397,247 8/1983 Lemelson .
4,403,555 9/1983 Forrest .
4,413,737 11/1983 Wind .
4,428,306 1/1984 Dresen et al. .
4,497,260 2/1985 Bucher ..... 108/901 X
4,550,830 11/1985 Shuert .
4,606,278 8/1986 Shuert .
4,674,414 6/1987 Nülle et al. .
4,742,781 5/1988 Shuert .
4,765,252 8/1988 Shuert .
4,774,892 10/1988 Ballard et al. ..... 108/55.1 X
4,809,618 3/1989 Bell .
4,815,394 3/1989 Ettlinger et al. .
4,856,657 8/1989 Shuert .
4,879,956 11/1989 Shuert .
4,896,612 1/1990 Salloum ..... 108/55.3
4,936,451 6/1990 Shuert .
4,947,988 8/1990 Schutz .
4,962,692 10/1990 Shuert .
4,976,092 12/1990 Shuert .
4,989,731 2/1991 Shuert .
5,042,396 8/1991 Shuert .
5,046,464 9/1991 Breezer et al. ..... 108/901 X
5,080,023 1/1992 Miura et al. ..... 108/55.3
5,108,529 4/1992 Shuert .
5,117,762 6/1992 Shuert .
5,168,817 12/1992 Nulle et al. .
5,193,598 3/1993 Estrem ..... 108/55.3 X
5,408,937 4/1995 Knight, IV et al. ..... 108/55.1 X

REINFORCED PLASTIC PALLET

RELATED CASES

This Application is a Continuation-In-Part of U.S. patent application Ser. No. 08/194,866 filed on Feb. 14, 1994 now U.S. Pat. No. 5,596,933.

TECHNICAL FIELD

This invention relates to a plastic pallet. More particularly, the invention relates to a thermoformed, plastic pallet. Specifically, the invention relates to a thermoformed, plastic pallet which is strengthened by a reinforcing bar received in a channel therein, and which is provided with strengthened support feet.

BACKGROUND OF THE INVENTION

Pallets are load bearing structures used to provide a stable platform for the storage, transportation or shipment of materials. The materials are often strapped or bound and then placed and/or stacked onto the pallet.

It is known to provide pallets with feet or other structures to raise the pallet off a support surface such as the ground, in order to allow a forklift blade to move under the pallet and to lift the entire load. While pallets are often made of wood, it is desirable to thermoform plastic pallets. Such plastic pallets are often stronger, less expensive, and less susceptible to degradation caused by weathering or the like than their wooden counterparts. Structures such as the feet, strengthening grooves and other components, may be formed in the pallets during the thermoforming operation. It is known to form "twin sheet" pallets, such that two sheets are softened and thermoformed together to make the finished pallet.

One method of forming pallets, including twin sheet pallets, has been to provide a first and second mold sections. A separate plastic blank sheet is then formed to each mold section, such as by vacuum-forming, and the two mold sections are then brought together under pressure until the plastic blank sheets, still at elevated temperatures from the vacuum-forming process, are in contact. The sections of the plastic blank sheets that are in contact are pressed together such that they actually fuse into a solid portion.

It has been known to further strengthen plastic pallets by the use of a reinforcing substructure or framework. Such substructures are often made of metal or wood. For example, a metal framework may be employed such that the pallet is thermoformed around the framework, such as by having the framework "sandwiched" between the two sheets of a twin sheet pallet.

Pallets having a metal or even wooden reinforced substructure are generally stronger than their non-reinforced counterparts. However, the substructures often dramatically increase the weight of the pallet. In storage and shipping operations, weight is usually a primary concern, and a pallet having an increased weight would likely be detrimental to the pallet's overall desirability.

Further, heretofore, while reinforced pallets have been known, such do not provide for improved resistance to torsional stresses at the outer edges of the pallets. Pallets are often stacked one on top of another for storage and transportation. The pallets are often stacked upon their outer edges. It is also sometimes the case that loaded pallets, that is, pallets bearing a load thereon, will be lifted by the edges of the pallet. Known reinforced pallets will not successfully compensate for induced edge stresses, which often result in torsional forces being applied to the pallet edges.

A need exists, therefore, for a reinforced pallet which does not dramatically differ in weight compared to an unreinforced counterpart, and which is successfully reinforced against induced torsional edge forces.

It is also desired that load bearing pallets be provided with retaining elements to support the load of material placed thereon, and thus help to prevent movement and shifting of the material on the pallet during transport and the like. For example, it is known to wrap material on pallets in plastic shrink wrap, or to band the material with metal or plastic straps. The materials are also often placed in boxes which can be stacked and secured in this manner. It is desirable to have a securing mechanism that will cooperate with the pallet itself to provide securing to the pallet. Thus, strapping is often wrapped around the materials and/or their storage boxes that are stacked on the pallet, and then around the pallet itself. Pallets are sometimes configured with slots to act as guide channels for the strapping material. While strapping has proven to be an effective means of securing stacked materials, shifting of the materials still occurs with known pallets.

A need exists therefore, for a pallet provided with a structure to minimize shifting of the materials stacked on the pallet during shipment and storage.

SUMMARY OF INVENTION

It is, therefore, an object of the present invention to provide a plastic pallet.

It is another object of the present invention to provide a reinforced plastic pallet.

It is yet another object of the present invention to provide a method of forming a reinforced plastic pallet.

It is a further object of the invention to provide a pallet with a retaining wall to help prevent movement of materials stacked on the pallet.

At least one or more of the foregoing objects, together with the advantages thereof over the known art relating to plastic pallets, which shall become apparent from the specification which follows, are accomplished by the invention as hereinafter described and claimed.

In general, the present invention provides a reinforced, thermoformed, plastic pallet for bearing a load, which includes a generally rectilinear body having an upper surface, a lower surface, and at least one pair of opposing sides. The pallet also includes at least one reinforcing bar-receiving channel extending substantially longitudinally between the at least one pair of opposing sides. Reinforcing bar means are received within the at least one reinforcing bar-receiving channel.

The present invention also includes a method for forming a reinforced plastic pallet including the steps of thermoforming a first and a second plastic blank into the shape of the desired pallet; the step of thermoforming including the steps of fusing selected portions of the first and second blanks together, and forming of selected open areas between the fused portions. At least one of the open areas is formed in the shape of a channel. The method also includes positioning a reinforcing bar within the channel.

There is also provided a method for vacuum-forming a twin sheet plastic pallet using a first mold section and a second mold section, and a separate plastic blank sheet formed on each of the mold sections. The method includes the steps of sealing a preselected portion of at least the first mold section, such that when one of the plastic blank sheets is vacuum-formed to the first mold section, the plastic blank sheet is not vacuum-formed in the preselected sealed portion. The method also includes individually vacuum-forming the plastic blank sheets to the first and second mold sections, and moving the first and second mold sections together, such that the plastic blank sheets are compressed together in at least the preselected sealed portion.

PREFERRED EMBODIMENT FOR CARRYING OUT THE INVENTION

Figure 1:
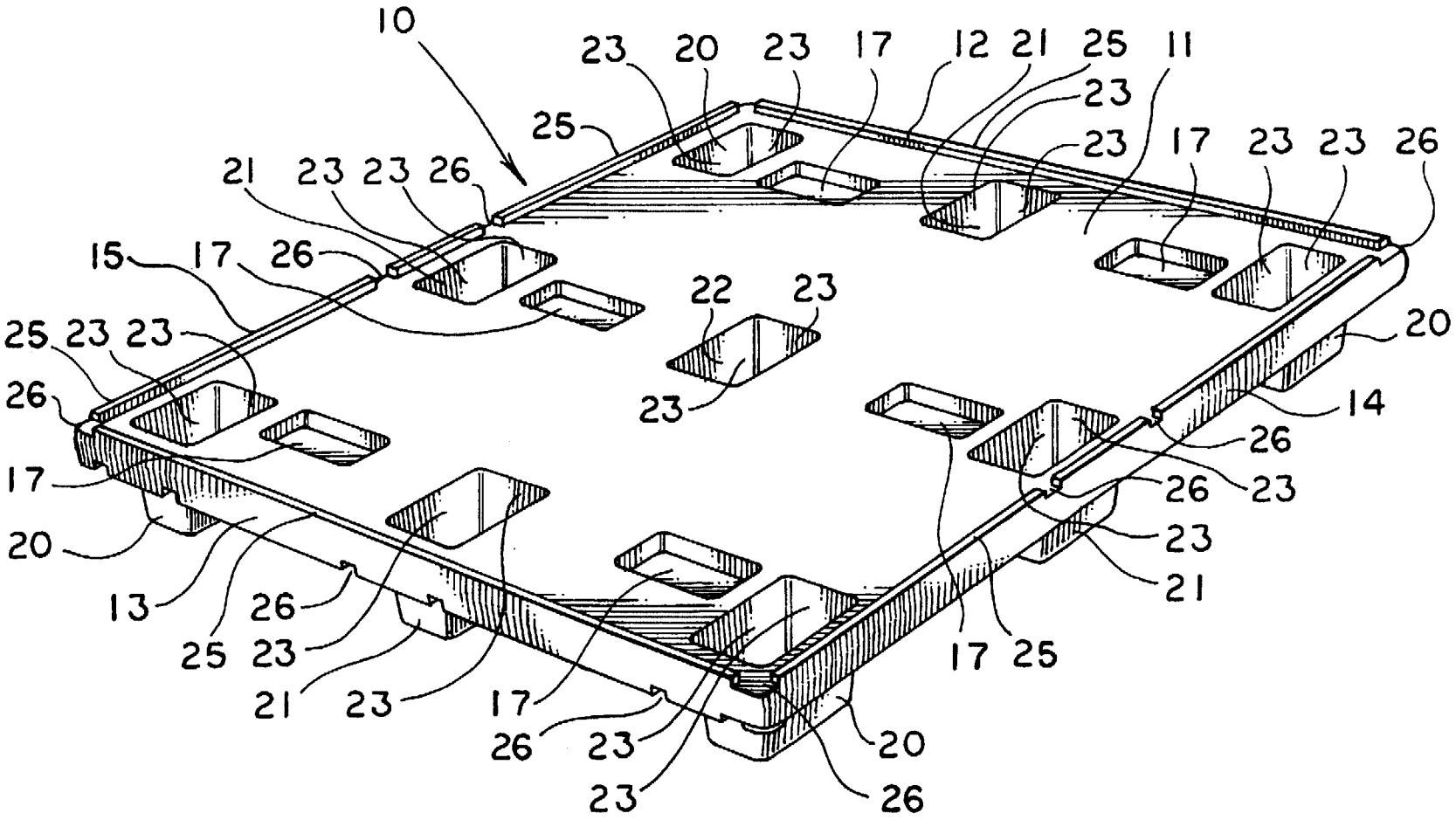
FIG. 1 is a perspective view of a pallet embodying the concepts of the present invention.

A pallet according to the present invention is generally designated by the number 10 on the attached drawings. Pallet 10 is the type useful for bearing a load, and may be provided with a generally planar, upper, load bearing surface 11. Pallet 10 is generally rectilinear, that is, pallet 10 is provided with spaced, opposing sides 12 and 13, as well as spaced opposing sides 14 and 15. Sides 12 and 13 are generally perpendicular to sides 15 and 16, and planar load bearing surface 11 generally extends between and connects sides 12, 13, 14 and 15. If desired, pallet 10 may be provided with apertures 17 for purposes of ventilation, weight saving, strength, or the like.

Pallet 10 is preferably provided with downwardly extending corner feet 20 which are used to raise pallet 10 from a support surface (not shown) such as the ground. Although the number of feet provided are not critical to the invention, it is preferred to provide pallet 10 with at least feet 20 in the corners of the pallet, and with feet 21 between each of the corner feet 20, as well as with a center foot 22. Each foot 20, 21, 22 preferably is provided with downwardly extending sidewalls 23 terminating in a foot floor 24 which extends between and interconnects downwardly extending sidewalls 23.

Pallet 10 may also be provided with edge protrusions or lips 25 which are used for strengthening pallet 10 and for aiding in the positioning of materials (not shown) upon pallet 10. Although not depicted in the drawings, lips or ribs similar to protrusions 25 may be positioned elsewhere on pallet 10 in order to further strengthen the pallet. Notches 26 may be provided in lips 25 and in side walls 12 and 13 to aid in tying down the materials on pallet 10, as well as for drainage and the like.

Although not necessarily an absolute limitation of the invention, it is preferred that pallet 10 is of a twin sheet, thermoformed construction. As is conventional in the art, it is known to vacuum, thermoform twin sheet pallets by employing a mold having a male section 30 (FIG. 8) and a female section 31. Separate plastic blank sheets 33 are heated and formed onto the male and female mold sections 30 and 31. As depicted in the drawings, the blank sheet to be formed on male mold 30 is numbered as blank sheet **33*a*, and the blank sheet to be formed on female mold 31 is numbered as blank sheet 33*b*. After pallet 10 is completed, blank sheet 33*a* is in a position on the top or upper side of pallet 10, while blank sheet 33*b* is positioned on the bottom or underneath side of pallet 10**.

A vacuum is pulled between the blank sheets **33*a* and 33*b* and the respective mold sections 30 and 31 in a conventional manner. It is often the case that a plurality of vacuum holes 34 are provided in each mold section, such that a vacuum can be pulled therethrough. The blank sheets 33 are thus pulled onto the mold sections 30 and 31, and conform to the shape thereof. The mold sections 30 and 31 can then be brought together (FIG. 9) such that the separate blank sheets are brought into physical contact. Depending upon the design of the mold sections, portions of the separate blank sheets 33** can be brought into contact while other portions do not contact. Under pressure, the contacting portions will weld or fuse together, forming an integral portion therebetween.

For example, each foot 20, 21 and 22 is preferably solid, such that there is substantially no open area between upper and lower sheets **33*a* and 33*b*. This "solid foot construction" adds to the overall strength of the pallet. The thermoforming process of an integral solid foot 20, 21 and 22** will be further addressed hereinbelow.

A preferred plastic material for formation of blank sheets 33 is high density polyethylene. The vacuum thermoforming processes for such a material will include heating the mold sections 30 and 31 to from about 180–280 degrees fahrenheit, while the plastic blank sheets 33 are generally heated to about 280 degrees fahrenheit. Other inventive characteristics of the methods according to the present invention will be further discussed hereinbelow.

The pallet 10 according to the invention is reinforced; that is, structure is provided which imparts greater strength to the pallet than the pallet would otherwise have. According to the present invention, at least one, and preferably a plurality of reinforcing bars 40 are used to reinforce pallet 10. Each reinforcing bar 40 is preferably of a "thin steel construction". That is, each reinforcing bar 40 has two opposing edges 41 and 42, which are generally parallel and spaced from the other by parallel opposing sides 43 and 44. The width dimension of edges 41 and 42 is preferably less than the width dimension of opposing sides 43 and 44, and hence, reinforcing bar 40 is of a thin steel construction. While it is preferred to make reinforcing bar 40 from steel, other materials such as other metals, plastic, wood or the like are also within the scope of the invention.

Figure 3:
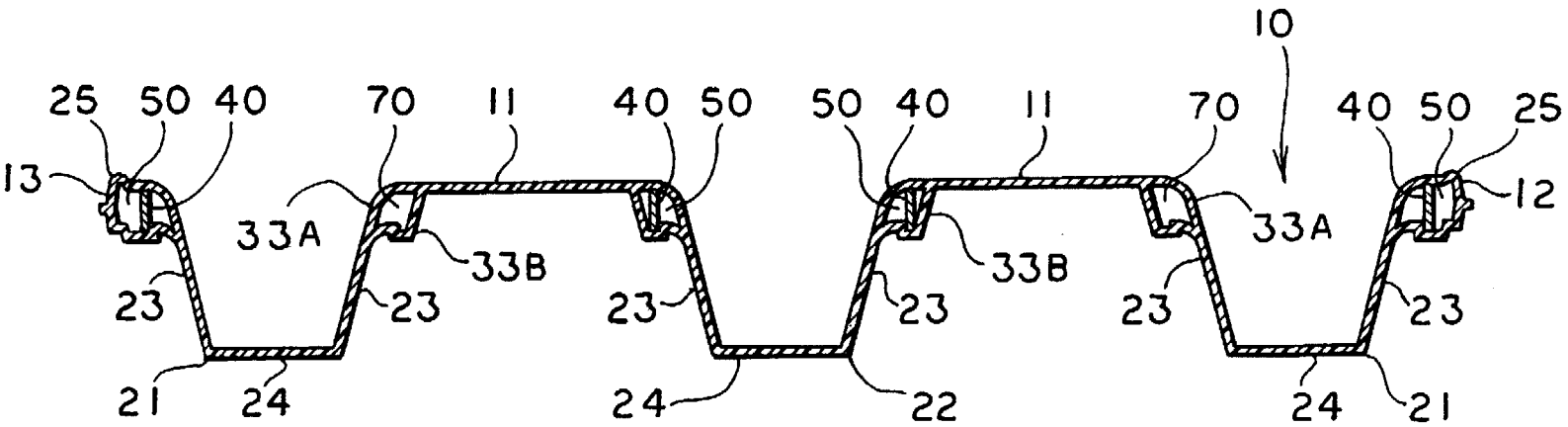
FIG. 3 is a sectional view taken substantially along line 3—3 of FIG. 2.
Figure 4:
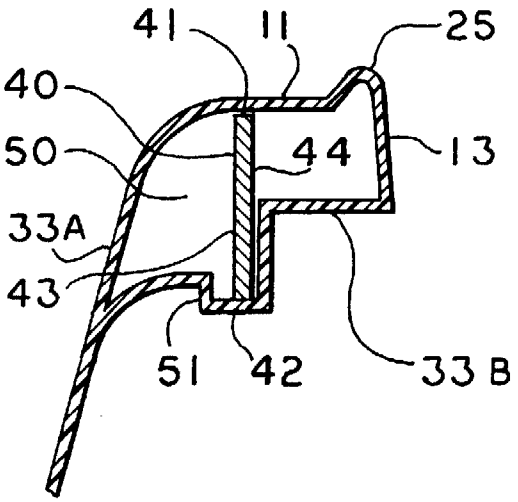
FIG. 4 is an enlarged view of one portion of FIG. 3.

Preferably, each reinforcing bar 40 is positioned within a reinforcing bar-receiving channel 50 within pallet 10. Channel 50 need be of no particular configuration. However, it is preferred that channel 50 be formed between portions of the two plastic blank sheets **33*a* and 33*b*, by forming areas therebetween which do not become fused together during the thermoforming process. Further, as shown in FIG. 3, a lip or ridge 51 may be provided in one or both of the blank sheets 33, such that reinforcing rod 40 is held in place by ridge 51, as shown with respect to lower blank sheet 33***b*.

Figure 6:
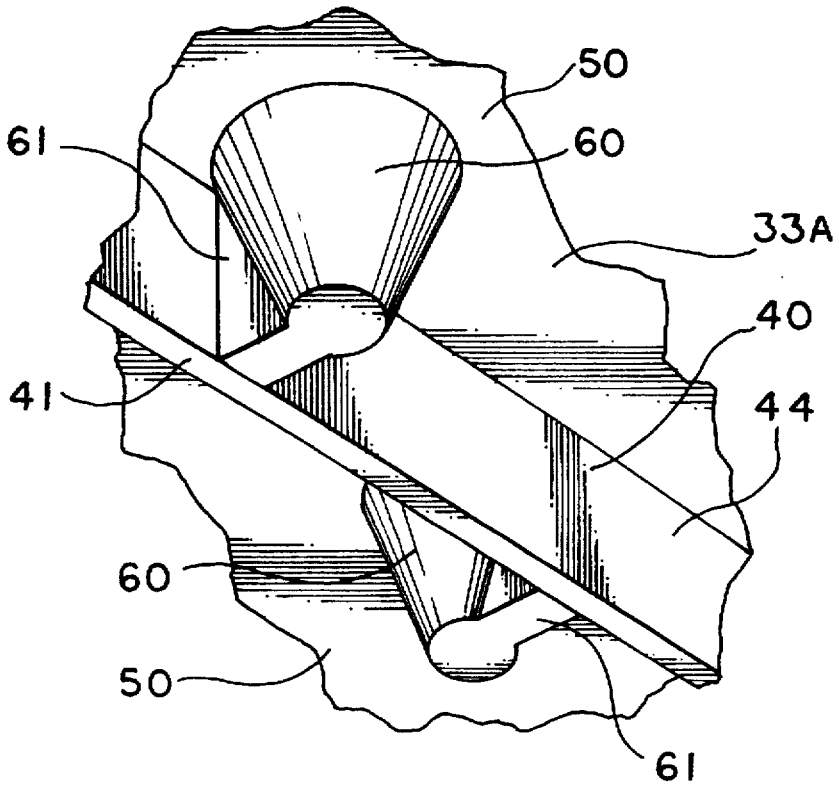
FIG. 6 is a fragmented, broken-away view of the pallet of FIG. 1, showing the details of the interior thereof.

Other means of forming channel 50 and for holding reinforcing bar 40 in place therein are within the scope of the invention. For example, channel 50 may be of a U-shaped, friction-fit construction (not shown). Also, pallet 10 may be provided with strengthening protrusions such as reinforcing cones 60. Cones 60 may be frusto-conical as depicted in FIG. 6. Cones 60 are preferably formed in a conventional thermoforming manner, and are used to provide strength between sheets 33*a* and 33*b*, and hence to pallet 10. Cones 60, or a preselected number thereof, may be thermoformed with positioning detents 61 which extend into channel 50 to a position proximate to reinforcing bar 40. Reinforcing bar 40 is restrained and positioned within channel 50 by physical contact with positioning detents 61. Other similar strengthening protrusions (not shown) may be provided throughout pallet 10, such as strengthening ribs, grooves and the like, with or without integral detents 61.

Reinforcing bars 40 are positioned within channels 50, such that they are "on-edge". That is, when positioned within channel 50, opposing sides 43 and 44 of reinforcing bar 40 are generally perpendicular to planar, load bearing surface 11 of pallet 10. Similarly, opposing edges 41 and 42 of reinforcing bar 40 are generally parallel to planar, load bearing surface 11. By being on-edge when positioned within channel 50, the strength of the pallet is increased. A load placed upon load bearing surface 12 will cause a force to be directed downward against the edge 41, which will be resisted by reinforcing bar 40, thus compensating for induced torsional forces upon pallet 10. The use of reinforcing bars 40 allows pallet 10 to be supported by a forklift, or other device, which can engage opposing support sides 14 and 15.

Figure 2:
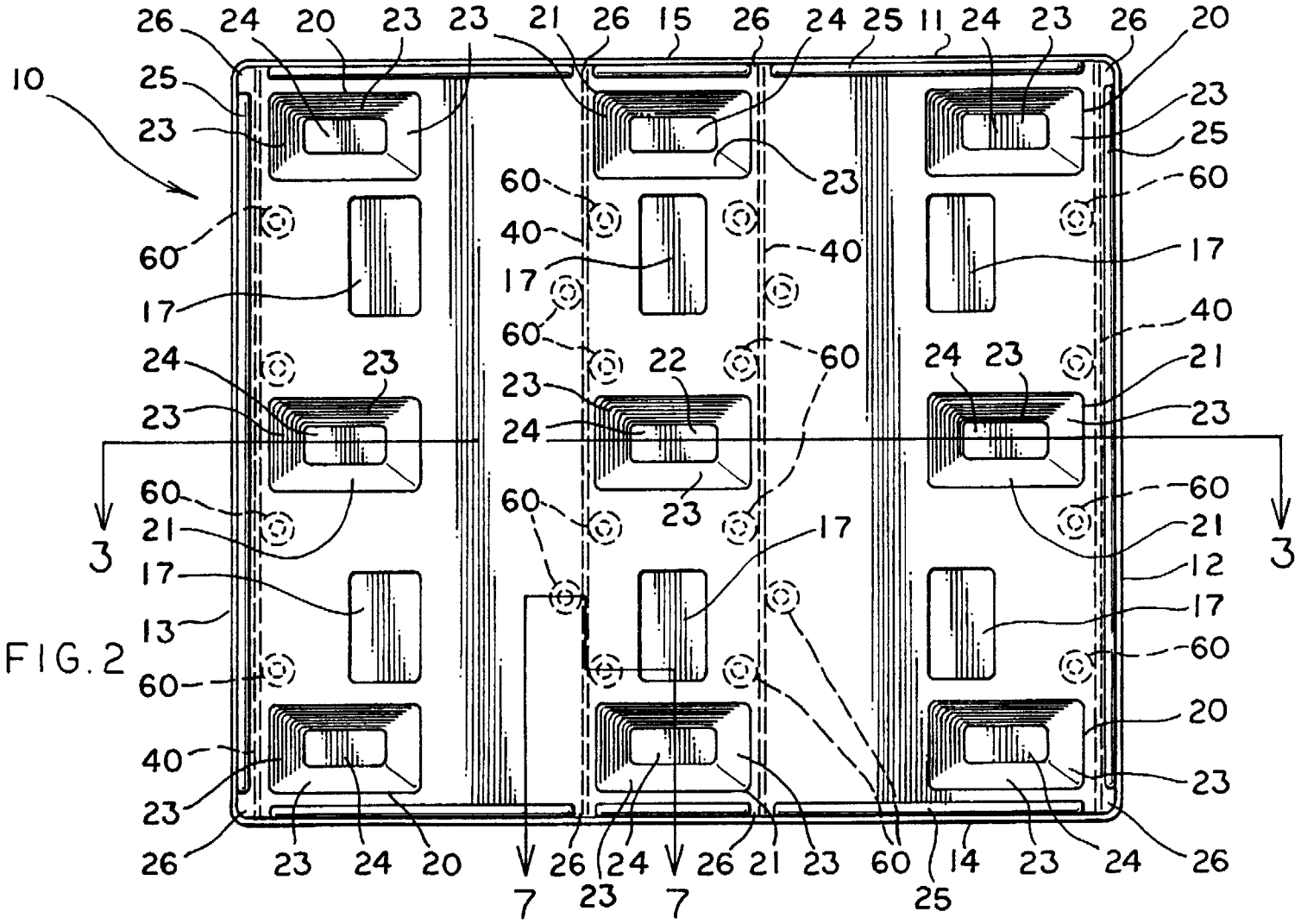
FIG. 2 is a top plan view of the pallet of FIG. 1.

As stated above, the number of reinforcing bars 40 positioned within pallet 10 is not critical to the invention. It is preferred however that a plurality of bars be positioned such that they are in a spaced parallel relation with each other. Each channel 50 is, therefore, also preferably provided in a spaced parallel manner, longitudinally extending between two sides, such as sides 14 and 15 of pallet 10. It is further preferred to position a reinforcing bar 40/channel 50 proximate to each of the edges 12 and 13 of pallet 10. In addition, it is preferred that two additional reinforcing bars 40/channels 50 may be positioned intermediate between those of and parallel to edges 12 and 13, as depicted in FIG. 2, thus providing interior reinforcing bars 40/channels 50.

Figure 5:
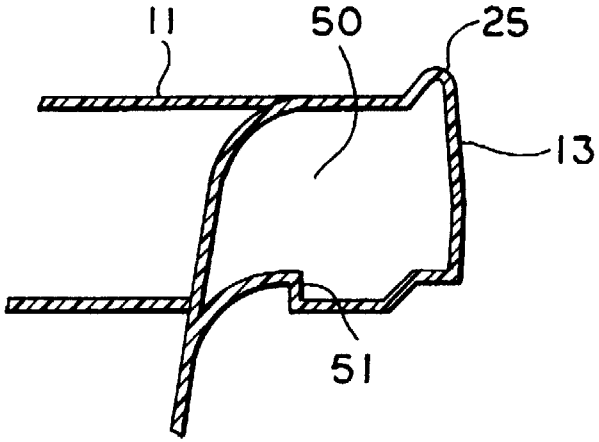
FIG. 5 is an enlarged view of another portion of FIG. 3.
Figure 7:
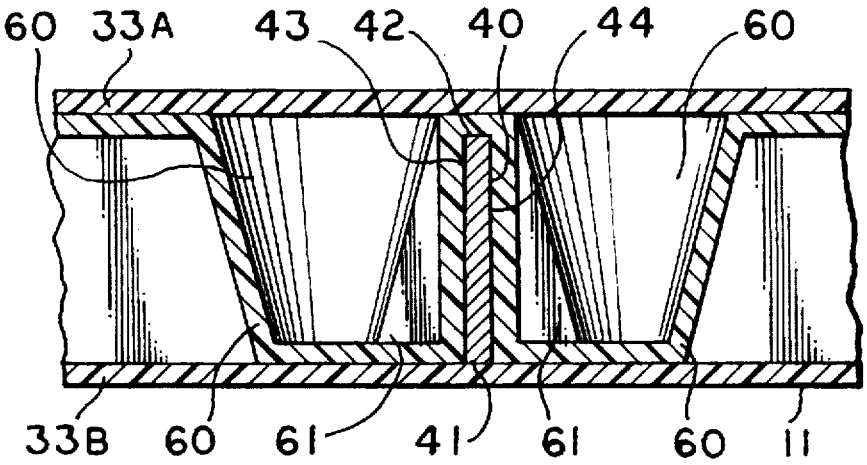
FIG. 7 is an enlarged, sectional view taken substantially along line 7—7 in FIG. 3.

As shown in FIG. 3, a number of additional intermediate channels 70 may be formed within pallet 10 during its thermoforming, such that reinforcing bars 40 may be positioned therein should the end user find the need for additional support. Similarly, for added weight savings, reinforcing bars 40 can be removed from channels 70 or even 50 should it be desirable as shown in FIG. 5. Any means for gaining access to channels 50 and 70 is within the scope of the invention. Thus, reinforcing bar 40 may be positioned within pallet 10 prior to moving mold sections 30 and/or 31, or it may be removably positioned therein subsequent to molding.

Figure 8:
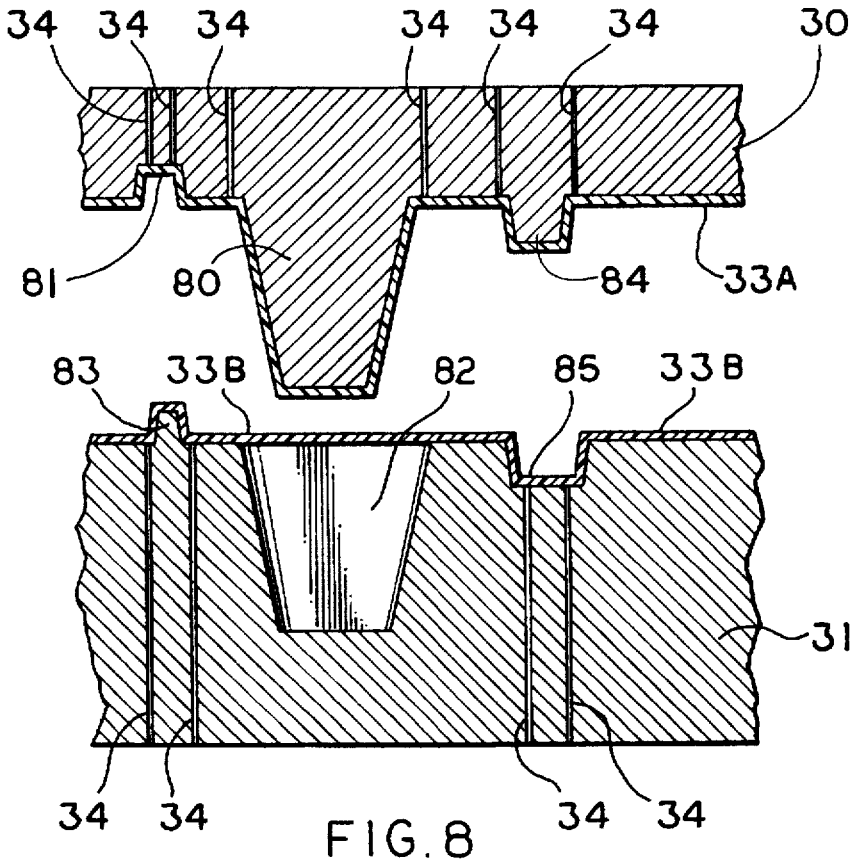
FIG. 8 is a fragmented sectional view of a portion of a mold useful in forming the pallet of FIG. 1, and showing two mold sections separated during the formation of the pallet.

With respect to the vacuum thermoforming procedure, as previously described and as shown in FIG. 8 male mold section 30 is provided with vacuum holes 34, and blank sheet 33*a* is formed thereto in a conventional manner. Male mold section 30 is provided with a profile for forming various portions of pallet 10. For example, protrusion 80 is employed for making a foot such as foot 20, 21 or 22, while cavity 81 may be employed for forming cones 60. Similarly, female mold section 31 is provided with foot cavity 82 corresponding to protrusion 80, and a protrusion 83 corresponding to cavity 81. Other profiles such as formed by protrusion 84 and cavity 85 may be provided as desired.

According to the invention, plastic blank sheet 33*b* is also thermoformed to female mold section 31 in a conventional manner, employing vacuum holes 34 thereof. However, the portion of sheet 33*b* proximate to each foot 20, 21 or 22 is not vacuum thermoformed. This may be accomplished by not providing vacuum holes 34 connected to foot cavity 82, as shown in the drawings. This may also be accomplished by providing apertures (not shown) connected to foot cavity 82, but through which no vacuum is pulled. Such "non-connected" apertures would be substantially identical in structure to vacuum apertures 34, except that they would be sealed off (not shown) or otherwise not connected to the vacuum during thermoforming. All such means may be referred to as "sealing" that portion of mold section 31. The resulting sheet 33*b*, as depicted in FIG. 8, is thermoformed to female mold section 31 as is conventional, except for the area proximate to foot cavity 82.

Figure 9:
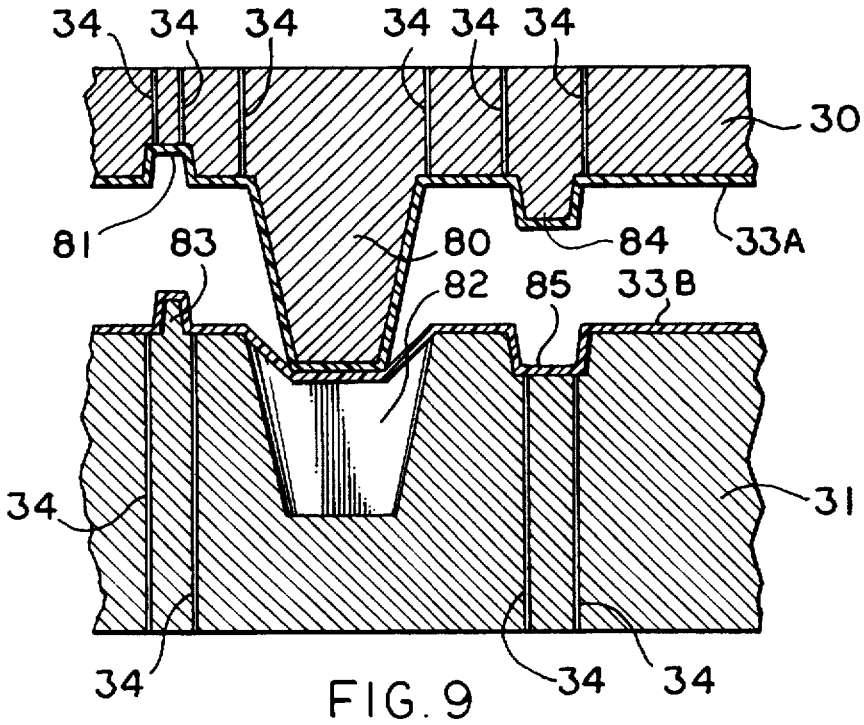
FIG. 9 is a view similar to FIG. 8, wherein the two mold sections have been moved closer together.
Figure 10:
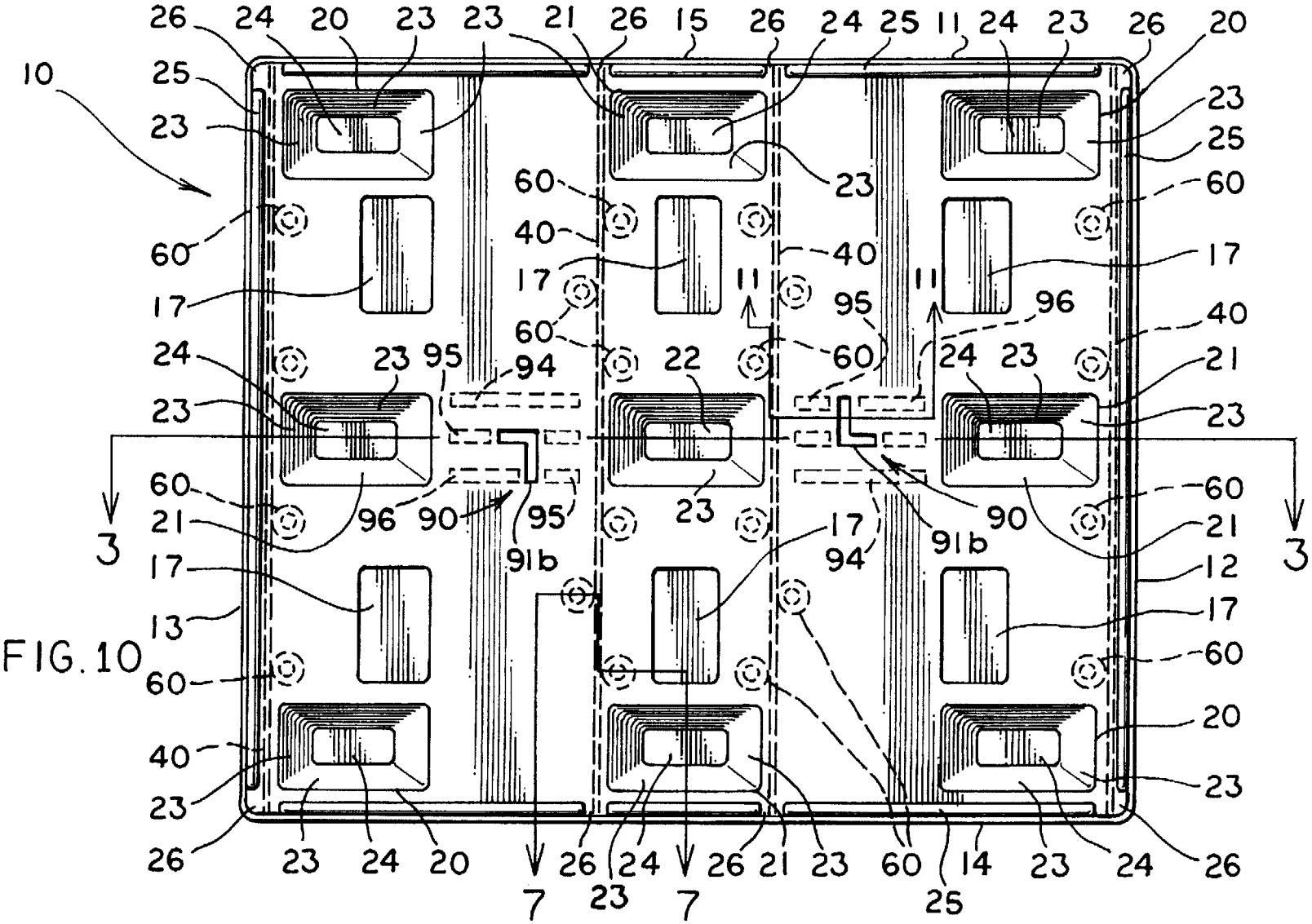
FIG. 10 is a top plan view of a pallet as in FIG. 2, shown with reinforcing slots in the top surface thereof, and showing reinforcing protrusions in phantom lines.

Immediately after vacuum thermoforming, or after sufficient heating to the softening temperatures such as those discussed above, one or the other or both male mold section 30 and female mold section 31 are moved toward one another. As shown in FIG. 9, sheet 33*a* thermoformed to protrusion 80 of male mold section 30 physically contacts sheet 33*b* proximate to foot cavity 82, forcing that portion of sheet 33*b*, which is soft and pliable at the elevated temperatures, into foot cavity 82. It will be appreciated that the portion of sheet 33*b* proximate to foot cavity 82 will remain at a higher temperature than contiguous portions of sheet 33*b*, because heat from the contiguous portions will be drawn away by mold section 31. By bringing mold sections 30 and 31 together under pressure (not shown) the feet 20, 21 and 22 of pallet 10 are formed by compression molding. This results in strong downwardly extending solid feet 20, 21 and 22.

As stated hereinabove, it is often the case that materials stacked on a pallet such as pallet 10, will be provided with structures such as bands or straps (not shown) to secure the materials to the pallet. In this manner, the movement of the materials during shipping is minimized.

In order to further minimize movement of stacked materials during shipping, there is provided according to the invention a retaining wall assembly 90 which preferably operates in cooperation with edge protrusion 25. That is, retaining wall assembly 90 is preferably positioned within sides 12, 13 and 15, 16 and also within edge protrusions 25. It is further preferred that retaining wall assembly 90 be generally centrally located in upper surface 11 of pallet 10, as depicted in the drawings. While the drawings depict two centrally located retaining wall assemblies 90, any number of such assemblies is within the scope of the invention.

Preferably, retaining wall assembly 90 is positioned at a mid portion of pallet 10, such that the material placed upon pallet 10 is held in position by cooperation between retaining wall assembly 90 and edge protrusion 25. As will be appreciated, movement of material stacked on pallet 10 will be minimized by contact with retaining wall assembly 90 and edge protrusion 25.

Figure 11:
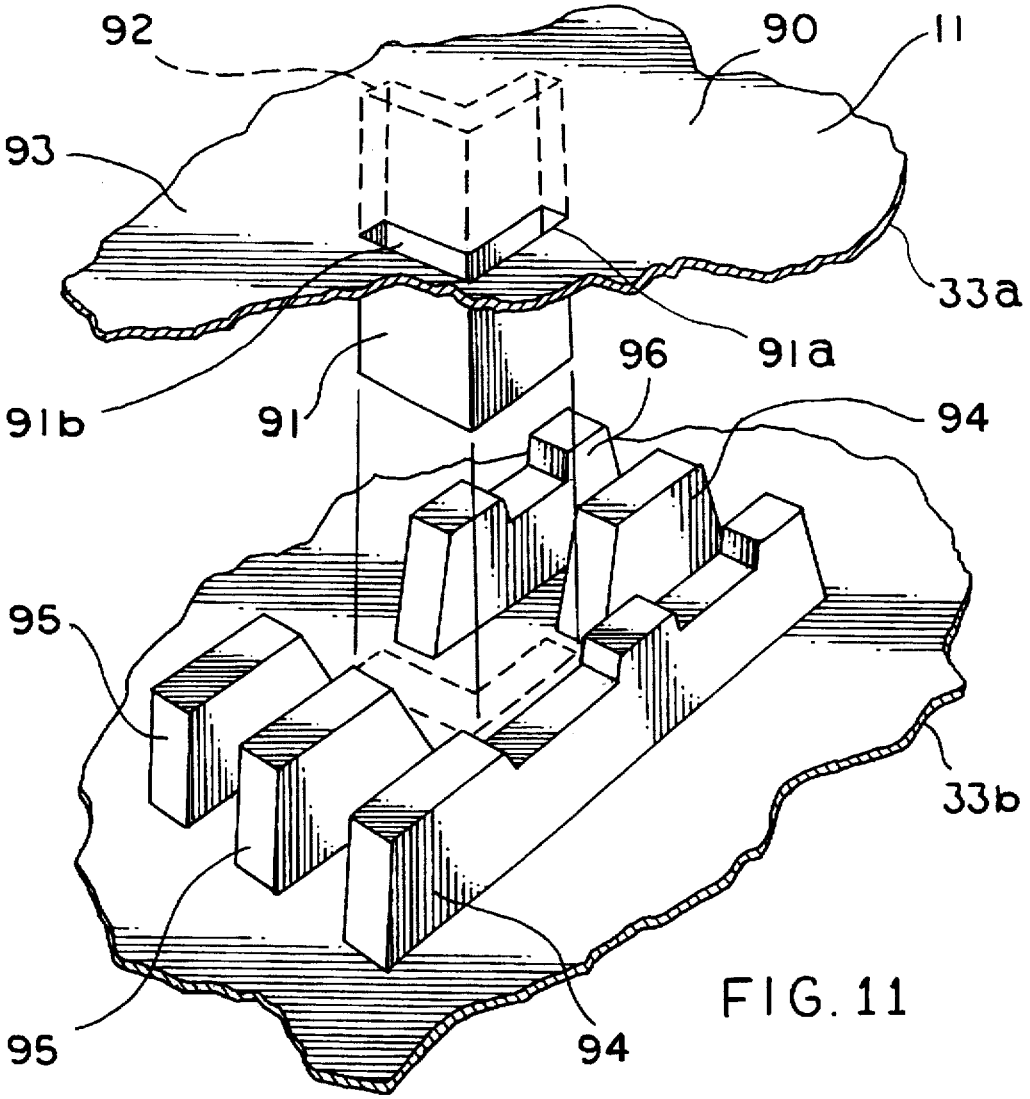
FIG. 11 is an exploded, fragmentary, perspective view of one portion of the pallet of FIG. 10.

It is preferred that retaining wall assembly 90 include a retaining wall-receiving slot 91, into which there may be inserted a retaining wall 92. Wall-receiving slot 91 is thermoformed as a downwardly extending portion of load bearing surface 11, formed in a manner similar to that described hereinabove with for example, feet 20. FIG. 11 shows the twin sheets 33*a* and 33*b* in an exploded view, such that the downwardly extending wall-receiving slot 91 is visible. An open area 93 (FIG. 11) into wall-receiving slot 91 is positioned in load bearing surface 11.

Retaining wall 92 may be formed from wood, metal, plastic or other suitable material, but is preferably corrugated cardboard for that material's well known desired strength versus weight ratio. A section of retaining wall 92 is positioned in retaining wall-receiving slot 91 by inserting it through open area 93, as shown by phantom lines in FIG. 11. Material placed upon pallet 10 will thus be held in place by contact with retaining wall 92 in a manner as described hereinabove. Retaining wall 92 need be at no particular shape or size, except that it be receivable within slot 91 as discussed hereinabove.

While wall-receiving slot 91 need no necessarily be of any particular configuration, it is preferred that it be "L-shaped" as depicted in the drawings. In this configuration, two retaining walls 92 may be positioned at an angle to each other, thus securing the material in two directions. Also, if the L-shaped slot 91 is employed with material placed in boxes and then stacked on the pallet 10, the L shape will cooperate with box corners in an efficient manner. It will be appreciated also that one retaining wall 92 may be employed with the L-shaped slot 91. In that case, the flexibility of cardboard allows one wall 92 to be flooded into an L shape.

Figure 12:
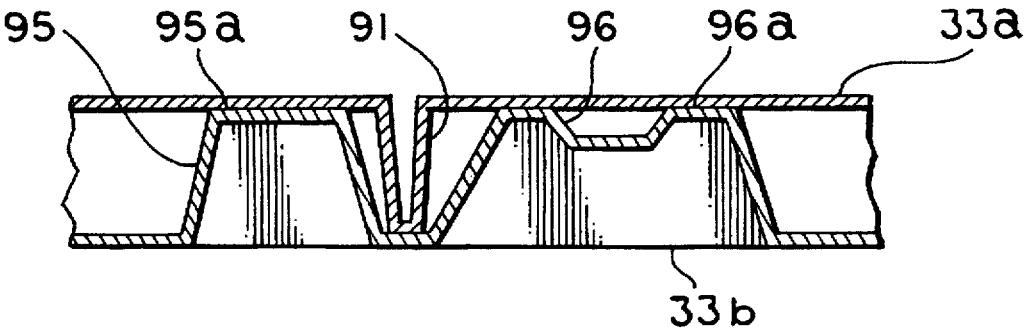
FIG. 12 is a fragmentary, side elevational, sectional view taken along line 11—11 of FIG. 10.

It is also preferred that slot 91 be narrow enough such that wall 92 is held in place by friction within slot 91, although other means of affixing wall 92 within slot 91 are within the scope of the invention, such as by being affixed with adhesives, bolts or the like. It is preferred to use the friction fit or other means for allowing wall 92 to be easily removed from slot 91. As shown in FIG. 12, one means of providing for a friction fit is to taper slot 91 inwardly and downwardly from open area 93.

Similarly, it desired to form slot 91 with a depth sufficient to allow wall 92 to be secured therein. The actual dimensions of slot 91, as will be appreciated, will vary depending upon the nature of wall 92, pallet 10 and the material to be stacked thereon. Wall 92 should be able to be positioned within slot 91 and removed therefrom by hand, and yet secured within slot 91 sufficiently to prevent its unintentional removal caused by forces exerted during pallet transportation and use.

Pallet 10 may also be provided with a reinforcing protrusion 94 formed preferably, as upwardly extending portions of second sheet 33*b* and extending between first and second sheets 33*a* and 33*b*. As best shown in FIG. 11, reinforcing protrusion 94 need be of no particular shape, and may for example be shaped as protrusions 95, 96 or any other shape as will be appreciated by one skilled in the art. Protrusions 94, 95 and 96 preferably extend upwardly from second sheet 33*b* and engage first sheet 33*a* at for example, location 95*a* and 96*a* (FIG. 12), and may actually be fused or otherwise affixed thereto. Because an open area may be formed between first sheet 33*a* and second sheet 33*b* during formation of slot 91, reinforcing protrusions 94, 95 and 96 may be used to support and provide strength between sheets 33*a* and 33*b* at that location. It will be appreciated of course, that reinforcing protrusions 94, 95 and 96 may extend downwardly from first sheet 33*a*. The reinforcing action thereof is provided by the extension between sheets 33*a* and 33*b* and is not necessarily dependent upon the sheet from which they extend. In fact, reinforcing protrusions 94, 95 and 96 my be separate members not formed in either sheet 33*a* or 33*b*.

Based upon the foregoing disclosure, it is apparent that the use of the pallet described herein will carry out the objects set forth hereinabove. It is, therefore, to be understood that any variations evident fall within the scope of the claimed invention and thus, the selection of specific component elements can be determined without departing from the spirit of the invention herein disclosed and described. In particular, the materials of construction, the actual configuration and the number of component elements of the pallet according to the present invention are not necessarily limited to those specifically discussed. Thus, the scope of the invention shall include all modifications and variations that may fall within the scope of the attached claims.

What is claimed is:

1. A thermoformed, plastic pallet for bearing and positioning a load, comprising a generally rectilinear body having an upper surface and a lower surface and at least one side surface, a retaining wall assembly carried by said upper surface; and an edge protrusion integrally formed in said upper surface having a longitudinal dimension substantially greater than its width such that the useful surface area of said upper surface is substantially unobstructed by said edge protrusion, said edge protrusion positioned approximate to at least one side surface, said edge protrusion extending upwardly from said upper surface so as to cooperate with said retaining wall assembly to position the load; said retaining wall assembly including a wall-receiving slot in said upper surface, said slot having a profile, and a wall positioned within said slot, said wall having a profile substantially similar to said profile of said slot such that the entire profile of said wall extends into said slot between said upper surface and said lower surface.

2. A pallet as set forth in claim 1, wherein said wall means is at least partially held in place within said slot by friction.

3. A pallet as set forth in claim 1, wherein said slot is L-shaped.

4. A pallet as set forth in claim 1, wherein said slot is downwardly and inwardly tapered.

5. A pallet as set forth in claim 1, further comprising reinforcing protrusions extending between said upper and lower surfaces.

6. A pallet as set firth in claim 1, wherein said wall is fabricated from a material selected from the group consisting of cardboard, wood, metal and plastic.

7. A pallet as set forth in claim 1, wherein said retaining wall assembly is centrally positioned within said upper surface.

8. A pallet as set forth in claim 1, wherein the pallet comprises a plurality of said retaining wall assemblies.

9. A reinforced, thermoformed, plastic pallet for bearing a load, comprising a generally rectilinear body having an upper surface and a lower surface and a pair of opposing support sides; at least one reinforcing bar-receiving channel extending substantially longitudinally between said at least one pair of opposing sides; reinforcing bar means received within said at least one reinforcing bar-receiving channel, said reinforcing bar means being of a thin-steel construction having a height dimension substantially greater than a width dimension, said bar positioned in the pallet such that said height dimension is substantially normal to said upper and lower surfaces; a retaining wall assembly carried by said upper surface; and at least one reinforcing protrusion extending between said upper and lower surfaces adjacent said retaining wall assembly, said upper surface and said lower surface contacting each other at said reinforcing protrusions; said retaining wall assembly including a wall-receiving slot in said upper surface and a retaining wall positioned within said slot to extend upwardly from said upper surface.

10. A pallet as set forth in claim 9, wherein said retaining wall assembly further comprises an edge protrusion positioned proximate to at least one said support side, such that said edge protrusion extends upwardly from said upper surface so as to cooperate with said retaining wall assembly to position the load.

11. A pallet as set forth in claim 9, wherein said wall means is at least partially held in place within said slot by friction.

12. A pallet as set forth in claim 9, wherein said slot is L-shaped.

13. A pallet as set forth in claim 9, wherein said slot is downwardly and inwardly tapered.

14. A pallet as set forth in claim 9, wherein said wall is fabricated from a material selected from cardboard, wood, metal and plastic.

15. A pallet as set forth in claim 9, wherein said retaining wall assembly is centrally positioned within said upper surface.

* * * * *